US006755724B2

(12) United States Patent
Shin et al.

(10) Patent No.: US 6,755,724 B2
(45) Date of Patent: Jun. 29, 2004

(54) DEVICE FOR GRINDING LIQUID CRYSTAL DISPLAY PANEL

(75) Inventors: Sang-Sun Shin, Kyoungsangbuk-Do (KR); Jong-Go Lim, Kyoungsangbok-Do (KR)

(73) Assignee: LG.Philips LCD Co., Ltd., Seoul (KR)

( * ) Notice: Subject to any disclaimer, the term of this patent is extended or adjusted under 35 U.S.C. 154(b) by 0 days.

(21) Appl. No.: 10/327,085

(22) Filed: Dec. 24, 2002

(65) Prior Publication Data

US 2003/0181130 A1 Sep. 25, 2003

(30) Foreign Application Priority Data

Mar. 21, 2002 (KR) ..... 2002-15452

(51) Int. Cl.[7] ..... B24B 1/00

(52) U.S. Cl. ..... 451/64; 451/28; 451/41; 451/44; 451/178; 451/190; 451/194; 451/261; 451/262; 451/364; 451/388

(58) Field of Search ..... 451/28, 41, 44, 451/64, 178, 190, 194, 261, 262, 364, 388, 368

(56) References Cited

U.S. PATENT DOCUMENTS

| | | | | |
|---|---|---|---|---|
| 3,978,580 A | | 9/1976 | Leupp et al. | |
| 4,094,058 A | | 6/1978 | Yasutake et al. | |
| 4,653,864 A | | 3/1987 | Baron et al. | |
| 4,685,180 A | * | 8/1987 | Kitaya et al. | 29/33 |
| 4,691,995 A | | 9/1987 | Yamazaki et al. | |
| 4,775,225 A | | 10/1988 | Tsuboyama et al. | |
| 5,247,377 A | | 9/1993 | Omeis et al. | |
| 5,263,888 A | | 11/1993 | Ishihara et al. | |
| 5,379,139 A | | 1/1995 | Sato et al. | |
| 5,406,989 A | | 4/1995 | Abe | |
| 5,499,128 A | | 3/1996 | Hasegawa et al. | |
| 5,507,323 A | | 4/1996 | Abe | |
| 5,511,591 A | | 4/1996 | Abe | |
| 5,539,545 A | | 7/1996 | Shimizu et al. | |
| 5,548,429 A | | 8/1996 | Tsujita | |
| 5,642,214 A | | 6/1997 | Ishii et al. | |
| 5,680,189 A | | 10/1997 | Shimizu et al. | |
| 5,742,370 A | | 4/1998 | Kim et al. | |
| 5,757,451 A | | 5/1998 | Miyazaki et al. | |

(List continued on next page.)

FOREIGN PATENT DOCUMENTS

| | | |
|---|---|---|
| EP | 1 003 066 A1 A1 | 5/2000 |
| JP | 51-065656 | 6/1976 |
| JP | 57-038414 A1 | 3/1982 |
| JP | 57-088428 A1 | 6/1982 |
| JP | 58-027126 A1 | 2/1983 |
| JP | 59-057221 | 4/1984 |
| JP | 59-195222 | 11/1984 |
| JP | 60-111221 | 6/1985 |
| JP | 60-164723 A1 | 8/1985 |
| JP | 60-217343 A1 | 10/1985 |
| JP | 61-007822 A1 | 1/1986 |
| JP | 61-055625 A1 | 3/1986 |
| JP | 62-089025 A1 | 4/1987 |
| JP | 62-090622 A1 | 4/1987 |
| JP | 62-205319 A1 | 9/1987 |
| JP | 63-109413 A1 | 5/1988 |

(List continued on next page.)

*Primary Examiner*—Joseph J. Hail, III
*Assistant Examiner*—Shantese L McDonald
(74) *Attorney, Agent, or Firm*—McKenna Long & Aldridge LLP

(57) ABSTRACT

Disclosed is a device for grinding a liquid crystal display panel improving the efficiency of using equipment by independently operating first and second grinding units for grinding the unit liquid crystal display panel. The present invention includes a first grinding unit grinding edges of short or long sides of the unit liquid crystal display panel in a normal mode and a second grinding unit grinding the edges of the short or long sides of the unit liquid crystal display panel that are not ground by the first grinding unit in the normal mode or grinding the edges of the long and short sides of the unit liquid crystal display panel in an emergency mode.

17 Claims, 6 Drawing Sheets

U.S. PATENT DOCUMENTS

| | | | | |
|---|---|---|---|---|
| 5,852,484 | A | | 12/1998 | Inoue et al. |
| 5,854,664 | A | | 12/1998 | Inoue et al. |
| 5,861,932 | A | | 1/1999 | Inata et al. |
| 5,875,922 | A | | 3/1999 | Chastine et al. |
| 5,952,676 | A | | 9/1999 | Sato et al. |
| 5,956,112 | A | | 9/1999 | Fujimori et al. |
| 6,001,203 | A | | 12/1999 | Yamada et al. |
| 6,011,609 | A | | 1/2000 | Kato et al. |
| 6,016,178 | A | | 1/2000 | Kataoka et al. |
| 6,016,181 | A | | 1/2000 | Shimada |
| 6,055,035 | A | | 4/2000 | von Gutfeld et al. |
| 6,163,357 | A | | 12/2000 | Nakamura |
| 6,219,126 | B1 | | 4/2001 | Von Gutfeld |
| 6,226,067 | B1 | | 5/2001 | Nishiguchi et al. |
| 6,236,445 | B1 | | 5/2001 | Foschaar et al. |
| 6,304,306 | B1 | | 10/2001 | Shiomi et al. |
| 6,304,311 | B1 | | 10/2001 | Egami et al. |
| 6,319,100 | B1 | * | 11/2001 | Denda et al. ..... 451/65 |
| 6,325,704 | B1 | * | 12/2001 | Brown et al. ..... 451/44 |
| 6,337,730 | B1 | | 1/2002 | Ozaki et al. |
| 6,361,867 | B2 | * | 3/2002 | Kishida et al. ..... 428/428 |
| 6,414,733 | B1 | | 7/2002 | Ishikawa et al. |
| 6,565,421 | B1 | * | 5/2003 | Choo ..... 451/41 |
| 2001/0021000 | A1 | | 9/2001 | Egami |

FOREIGN PATENT DOCUMENTS

| | | | |
|---|---|---|---|
| JP | 63-110425 | A1 | 5/1988 |
| JP | 63-128315 | A1 | 5/1988 |
| JP | 63-311233 | A1 | 12/1988 |
| JP | 05-127179 | A1 | 5/1993 |
| JP | 05-154923 | | 6/1993 |
| JP | 05-265011 | A1 | 10/1993 |
| JP | 05-281557 | A1 | 10/1993 |
| JP | 05-281562 | A1 | 10/1993 |
| JP | 06-051256 | A1 | 2/1994 |
| JP | 06-148657 | A1 | 5/1994 |
| JP | 06-160871 | | 6/1994 |
| JP | 06-235925 | | 8/1994 |
| JP | 06-265915 | A1 | 9/1994 |
| JP | 06-313870 | | 11/1994 |
| JP | 07-084268 | | 3/1995 |
| JP | 07-128674 | A1 | 5/1995 |
| JP | 07-181507 | A1 | 7/1995 |
| JP | 08-095066 | A1 | 4/1996 |
| JP | 08-101395 | | 4/1996 |
| JP | 08-106101 | A1 | 4/1996 |
| JP | 08-171094 | A1 | 7/1996 |
| JP | 08-190099 | A1 | 7/1996 |
| JP | 08-240807 | A1 | 9/1996 |
| JP | 09-005762 | A1 | 1/1997 |
| JP | 09-026578 | A1 | 1/1997 |
| JP | 09-061829 | | 3/1997 |
| JP | 09-073075 | A1 | 3/1997 |
| JP | 09-073096 | A1 | 3/1997 |
| JP | 09-127528 | A1 | 5/1997 |
| JP | 09-230357 | A1 | 9/1997 |
| JP | 09-281511 | A1 | 10/1997 |
| JP | 09-311340 | A1 | 12/1997 |
| JP | 10-123537 | A1 | 5/1998 |
| JP | 10-123538 | A1 | 5/1998 |
| JP | 10-142616 | A1 | 5/1998 |
| JP | 10-177178 | | 6/1998 |
| JP | 10-221700 | A1 | 8/1998 |
| JP | 10-282512 | A1 | 10/1998 |
| JP | 10-333157 | | 12/1998 |
| JP | 10-333159 | | 12/1998 |
| JP | 11-014953 | A1 | 1/1999 |
| JP | 11-038424 | A1 | 2/1999 |
| JP | 11-064811 | A1 | 3/1999 |
| JP | 11-109388 | A1 | 4/1999 |
| JP | 11-133438 | | 5/1999 |
| JP | 11-142864 | | 5/1999 |
| JP | 11-174477 | A1 | 7/1999 |
| JP | 11-212045 | A1 | 8/1999 |
| JP | 11-248930 | | 9/1999 |
| JP | 11-326922 | | 11/1999 |
| JP | 11-344714 | A1 | 12/1999 |
| JP | 2000-002879 | | 1/2000 |
| JP | 2000-029035 | | 1/2000 |
| JP | 2000-056311 | | 2/2000 |
| JP | 2000-066165 | | 3/2000 |
| JP | 2000-137235 | | 5/2000 |
| JP | 2000-147528 | | 5/2000 |
| JP | 2000-193988 | | 7/2000 |
| JP | 2000-241824 | | 9/2000 |
| JP | 2000-284295 | | 10/2000 |
| JP | 2000-292799 | | 10/2000 |
| JP | 2000-310759 | | 11/2000 |
| JP | 2000-310784 | | 11/2000 |
| JP | 2000-338501 | | 12/2000 |
| JP | 2001-005401 | | 1/2001 |
| JP | 2001-005405 | | 1/2001 |
| JP | 2001-013506 | | 1/2001 |
| JP | 2001-033793 | A1 | 2/2001 |
| JP | 2001-042341 | | 2/2001 |
| JP | 2001-051284 | | 2/2001 |
| JP | 2001-066615 | | 3/2001 |
| JP | 2001-091727 | | 4/2001 |
| JP | 2001-117105 | | 4/2001 |
| JP | 2001-117109 | | 4/2001 |
| JP | 2001-133745 | | 5/2001 |
| JP | 2001-133794 | | 5/2001 |
| JP | 2001-133799 | | 5/2001 |
| JP | 2001-142074 | | 5/2001 |
| JP | 2001-147437 | | 5/2001 |
| JP | 2001-154211 | | 6/2001 |
| JP | 2001-166272 | | 6/2001 |
| JP | 2001-166310 | | 6/2001 |
| JP | 2001-183683 | | 7/2001 |
| JP | 2001-209052 | | 8/2001 |
| JP | 2001-209060 | | 8/2001 |
| JP | 2001-222017 | | 8/2001 |
| JP | 2001-235758 | | 8/2001 |
| JP | 2001-215459 | | 9/2001 |
| JP | 2001-255542 | | 9/2001 |
| JP | 2001-264782 | | 9/2001 |
| JP | 2001-201750 | | 10/2001 |
| JP | 2001-272640 | | 10/2001 |
| JP | 2001-281675 | | 10/2001 |
| JP | 2001-281678 | | 10/2001 |
| JP | 2001-282126 | | 10/2001 |
| JP | 2001-305563 | | 10/2001 |
| JP | 2001-330837 | | 11/2001 |
| JP | 2001-330840 | A1 | 11/2001 |
| JP | 2001-356353 | | 12/2001 |
| JP | 2001-356354 | A1 | 12/2001 |
| JP | 2002-014360 | A1 | 1/2002 |
| JP | 2002-023176 | A1 | 1/2002 |
| JP | 2002-049045 | A1 | 2/2002 |
| JP | 2002-082340 | A1 | 3/2002 |
| JP | 2002-090759 | A1 | 3/2002 |
| JP | 2002-090760 | A1 | 3/2002 |
| JP | 2002-107740 | A1 | 4/2002 |
| JP | 2002-122872 | A1 | 4/2002 |
| JP | 2002-122873 | A1 | 4/2002 |
| JP | 2002-139734 | | 5/2002 |
| JP | 2002-202512 | A1 | 7/2002 |
| JP | 2002-202514 | A1 | 7/2002 |
| JP | 2002-214626 | A1 | 7/2002 |
| KR | 2000-035302 | A1 | 6/2000 |

* cited by examiner

DEVICE FOR GRINDING LIQUID CRYSTAL DISPLAY PANEL

This application claims the benefit of the Korean Patent Application No. P2002-15452 filed on Mar. 21, 2002, which is hereby incorporated by reference for all purposes as if fully set forth herein.

BACKGROUND OF THE INVENTION

1. Field of the Invention

The present invention relates to a device for grinding a liquid crystal display panel, and, more particularly, a device that grinds edges of a unit liquid crystal display panel after liquid crystal display panels fabricated on a pair of wide mother substrates are cut into individual unit liquid crystal display panels.

2. Background of the Related Art

Generally, in a liquid crystal display device, data signals are supplied to liquid crystal cells arranged in a matrix according to image information to display a demanded image by controlling a light-transmittance of each of the liquid crystal cells.

The process of cutting a large mother substrate into unit liquid crystal display panels generally includes a process of forming a scribing line on a substrate of a mother substrate using a pen having a hardness greater than that of glass and a process of propagating a crack along the scribing line. Such a cutting process of the unit panels is explained in detail by referring to the attached drawings.

FIG. 1 illustrates a cross-sectional view of a first mother substrate having thin film transistor array substrates and a second mother substrate having color filter substrates, in which the first and second mother substrates are bonded to each other to construct a plurality of liquid crystal display panels.

Referring to FIG. 1, in unit liquid crystal display panels, each of thin film transistor array substrates 1 has one side protruding longer than that of each of corresponding color filter substrates 2. This is because gate and data pad parts(not shown in the drawing) are formed at the corresponding edges of the thin film transistor array substrate 1 that are not overlapped by the color filter substrate 2.

Hence, the color filter substrates 2 on the second mother substrate 30 are separated from each other by a dummy area 31 that corresponds to the area of each of the thin film transistor array substrates 1 on the first mother substrate 20 that does not overlap the color filter substrate 2.

Moreover, the unit liquid crystal display panels are arranged properly to make best use of the first and second mother substrates 20 and 30. Depending on the models being fabricated, the unit liquid crystal display panels are generally formed to be separated from each other by an area of another dummy area 32.

After the first mother substrate having the thin film transistor array substrates 1 has been bonded to the second mother substrate 30 having the color filter substrates 2, the liquid crystal display panels are individually cut. In this case, the dummy area 31 of each of the color filter substrates 2 of the second mother substrate 30 and the other dummy area 32 separating the unit liquid crystal display panels from each other are removed simultaneously.

FIG. 2 illustrates a schematic layout of an individually cut unit liquid crystal display panel according to a related art.

Referring to FIG. 2, a unit liquid crystal display panel 10 includes an image display part 13 having liquid crystal cells arranged in a matrix form, a gate pad part 14 connecting gate lines GL1~GLm of the image display part 13 to a gate driver integrated circuit(not shown in the drawing) for supplying gate signals, and a data pad part 15 connecting data lines DL1~DLn of the image display part 13 to a data driver integrated circuit(not shown in the drawing) for supplying image information. In this case, the gate and data pad parts 14 and 15 are formed on edge areas of a thin film transistor array substrate 1 having long sides and short sides protruding longer than those of a color filter substrate 2.

In this case, the data and gate lines DL1~DLn and GL1~GLm cross each other on the thin film transistor array substrate 1. Thin film transistors (TFTs) are formed at the crossings of the gate and data lines to switch respective liquid crystal cells. Pixel electrodes are connected to the thin film transistors to apply electric fields to the corresponding liquid crystal cells, and a passivation layer is formed on an entire surface to protect the data lines DL1~DLn, gate lines GL1~GLm, thin film transistors, and electrodes.

Color filters are formed on the color filter substrate 2 and are separated from adjacent cells by a black matrix. A common electrode is also formed on the color filter substrate 2 as a counter electrode of the pixel electrodes on the thin film transistor array substrate 1.

A cell gap is provided between thin film transistor array and color filter substrates 1 and 2, which face each other, to leave a predetermined interval between them. The thin film transistor array and color filter substrates 1 and 2 are bonded to each other by a sealing part(not shown in the drawing) formed on a periphery of the image display part 13. A liquid crystal layer(not shown in the drawing) is formed in the cell gap.

Meanwhile, a short-circuiting line number (not shown in the drawing) is formed on an edge of the thin film transistor array substrate 1 in order to prevent static electricity generated by the patterned conductive layers on the thin film transistor array substrate 1.

The short-circuiting line should be removed after the liquid crystal display panels are cut into individual unit liquid crystal display panels.

Hence, after the liquid crystal display panels have been cut into individual unit liquid crystal display panels, edges of the unit liquid crystal display panel are ground to remove the short-circuiting line. Moreover, the edges of the unit liquid crystal display panel are ground to prevent the edges from being torn apart by an external impact as well as the danger of hurting an operator with the sharp edges of the unit liquid crystal display panel.

A process of grinding the above-explained unit liquid crystal display panel is explained in detail by referring to the attached drawing as follows.

FIG. 3 illustrates a block diagram of a device for grinding a liquid crystal display panel according to a related art.

Referring to FIG. 3, a device for grinding a liquid crystal display panel according to a related art includes a loading unit 50 for loading a unit liquid crystal display panel 10, a first grinding unit 53 for receiving the unit liquid crystal display panel 10 loaded by the loading unit 50 on a first grinding table 51 and for grinding short sides of the unit liquid crystal display panel 10 through a first grinding wheel 52, a turning unit 54 for turning the unit liquid crystal display panel 10 by 90° after its short sides have been ground, a second grinding unit 57 for receiving the turned unit liquid crystal display panel 10 on a second grinding table 55 and for grinding long sides of the unit liquid crystal display panel 10 through a second grinding wheel 56, an unloading unit 58 for receiving to unload the unit liquid crystal display panel 10 after its long sides have been ground.

Thus, in order to grind the edges of the unit liquid crystal display panel 10 in the device for grinding the liquid crystal display panel according to the related art, the first grinding unit 53 grinds the short sides of the unit liquid crystal display panel 10; then, the turning unit 54 turns the unit liquid crystal display panel 10 having the grinded short sides by 90°, and the second grinding unit 57 grinds the long sides of the unit liquid crystal display panel 10.

As mentioned in the foregoing explanation, in order to grind the edges of the unit liquid crystal display panel, the device for grinding the liquid crystal display panel according to the related art has the first grinding unit grind the short sides of the unit liquid crystal display panel and has the second grinding unit grind the long sides of the unit liquid crystal display panel. If the first or second grinding unit is broken or malfunctions, the related art grinding device cannot grind all edges of the unit liquid crystal display panel until it is fixed. Hence, the device for grinding the liquid crystal display panel according to the related art has a reduced efficiency thereby decreasing productivity.

SUMMARY OF THE INVENTION

Accordingly, the present invention is directed to a device for grinding a liquid crystal display panel that substantially obviates one or more problems due to limitations and disadvantages of the related art.

An advantage of the present invention is to provide a device for grinding a liquid crystal display panel to improve an equipment using efficiency by independently operating first and second grinding units for grinding the unit liquid crystal display panel.

Additional advantages and features of the invention will be set forth in part in the description that follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these and other advantages and in accordance with the purpose of the invention, as embodied and broadly described herein, a device for grinding a liquid crystal display panel according to the present invention includes a first grinding unit for grinding edges of one of short and long sides of the unit liquid crystal display panel in a normal mode and a second grinding unit for grinding the edges of the other of the short and long sides of the unit liquid crystal display panel and for grinding the edges of the long and short sides of the unit liquid crystal display panel in an emergency mode.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principles of the invention.

In the drawings.

DETAILED DESCRIPTION OF THE ILLUSTRATED EMBODIMENTS

Reference will now be made in detail to the preferred embodiments of the present invention, examples of which are illustrated in the accompanying drawings.

Figure 1:
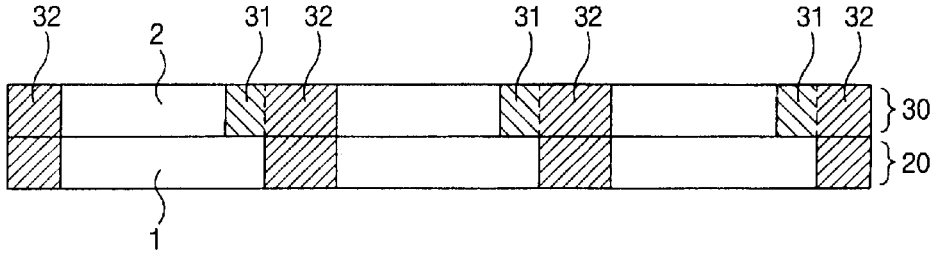
FIG.1 RELATED ART
FIG. 1 illustrates a cross-sectional view of a first mother substrate having thin film transistor array substrates and a second mother substrate having color filter substrates according to a related art, in which the first and second mother substrates are bonded to each other to construct a plurality of unit liquid crystal display panels.
Figure 2:
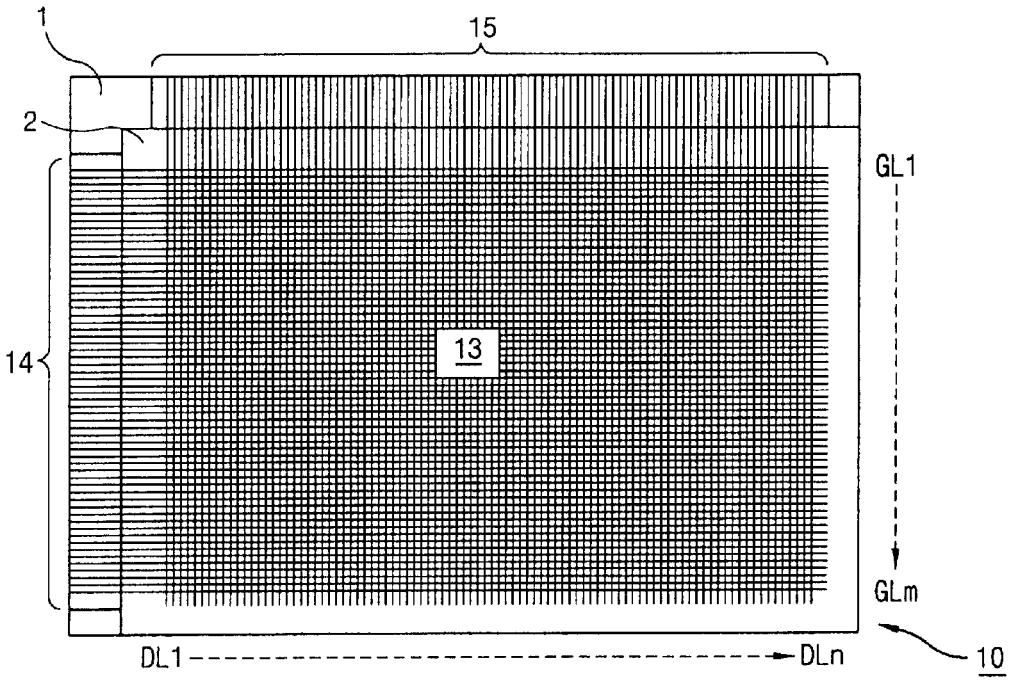
FIG.2 RELATED ART
FIG. 2 illustrates a schematic layout of an individually cut unit liquid crystal display panel according to a related art.
Figure 3:
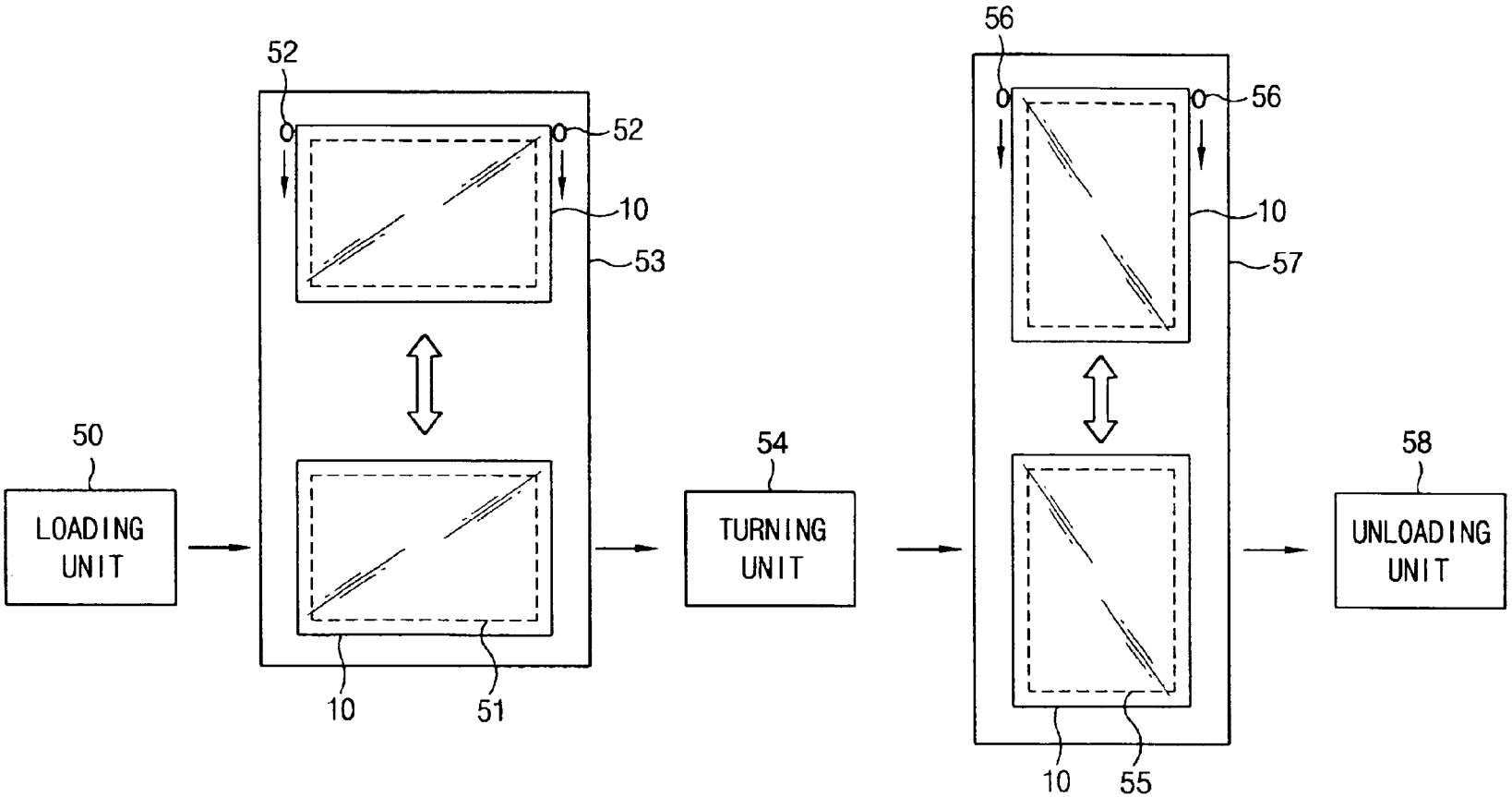
FIG. 3 RELATED ART
FIG. 3 illustrates a block diagram of a device for grinding a liquid crystal display panel according to a related art.
Figure 4:
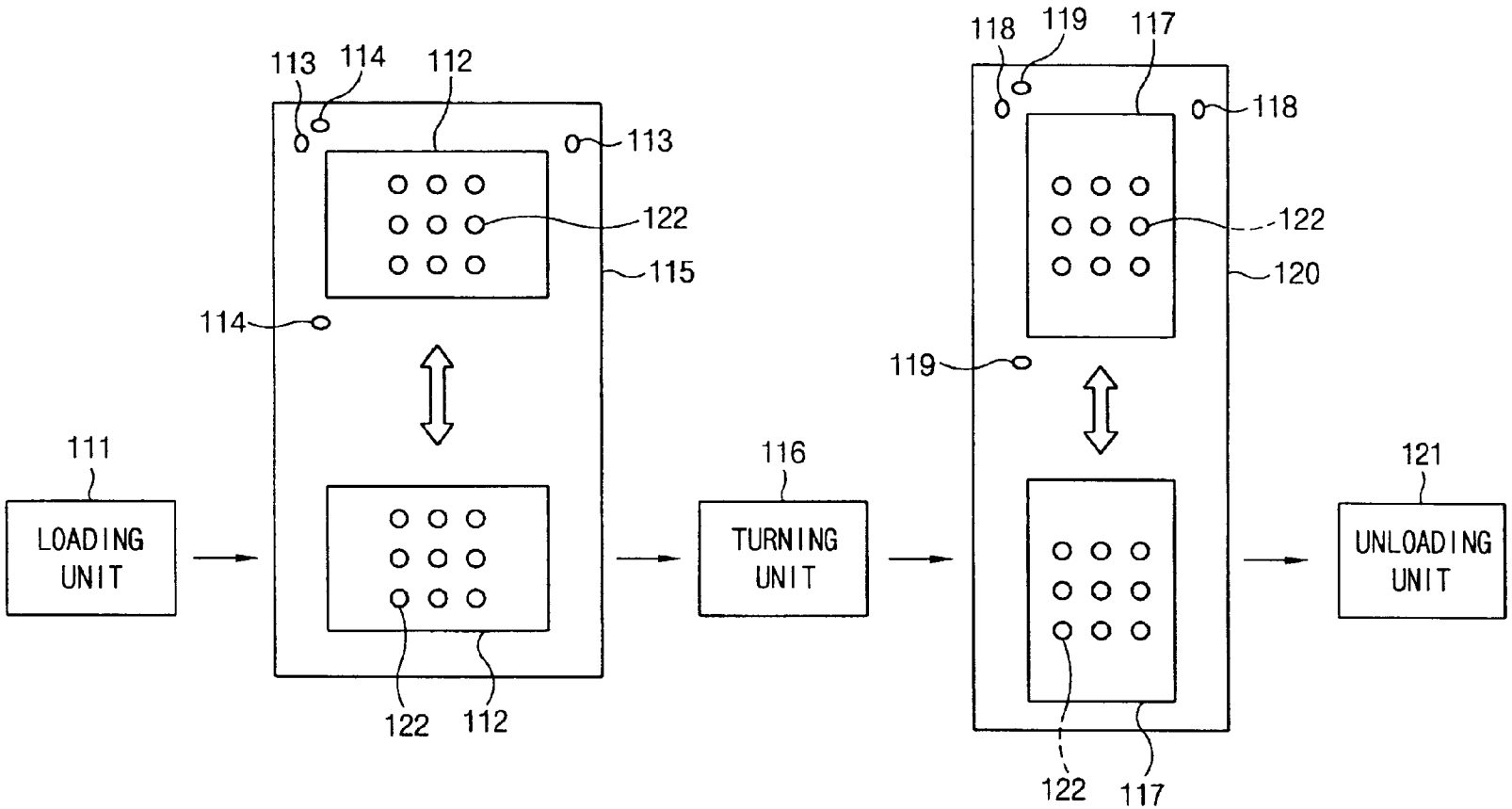
FIG. 4 illustrates a block diagram of a device for grinding a liquid crystal display panel according to one embodiment of the present invention.

FIG. 4 illustrates a block diagram of a device for grinding a liquid crystal display panel according to one embodiment of the present invention.

Referring to FIG. 4, a device for grinding a liquid crystal display panel according to one embodiment of the present invention includes a loading unit 111 loading a liquid crystal display panel, and a first grinding unit 115 receiving the unit liquid crystal display panel on a first grinding table 112 and grinding edges of short sides of the unit liquid crystal display panel through a first grinding wheel 113 in a normal mode. The first grinding unit can also grind the edges of the short sides and edges of long sides of the unit liquid crystal display panel through the first grinding wheel 113 and a second grinding wheel 114, respectively, in an emergency mode. The device for grinding also includes a turning unit 116 turning the unit liquid crystal display panel by 90° after the edges of the short sides have been ground in the first grinding unit 115, in the normal mode; a second grinding unit 120 receiving the unit liquid crystal display panel turned by the turning unit 116 and grinding the edges of the long sides of the unit liquid crystal display panel through a third grinding wheel 118 in the normal mode. The second grinding unit can also grind the edges of the long and short sides of the unit liquid crystal display panel through the third grinding wheel 118 and a fourth grinding wheel 119 respectively in the emergency mode; and an unloading unit 121 receiving the unit liquid crystal display panel after the edges of the short and long sides have been ground by the first and second grinding units 115 and 120 in the normal mode or by the first and second grinding units 115 and 120 in the emergency mode.

A plurality of suction holes 122 for absorbing the unit liquid crystal display panel effectively by suction are preferably formed on surfaces of the first and second grinding tables 112 and 117 of the first and second grinding units 115 and 120, respectively.

Operation of the device for grinding the liquid crystal display panel according to one embodiment of the present invention is explained in detail as follows.

Figure 5:
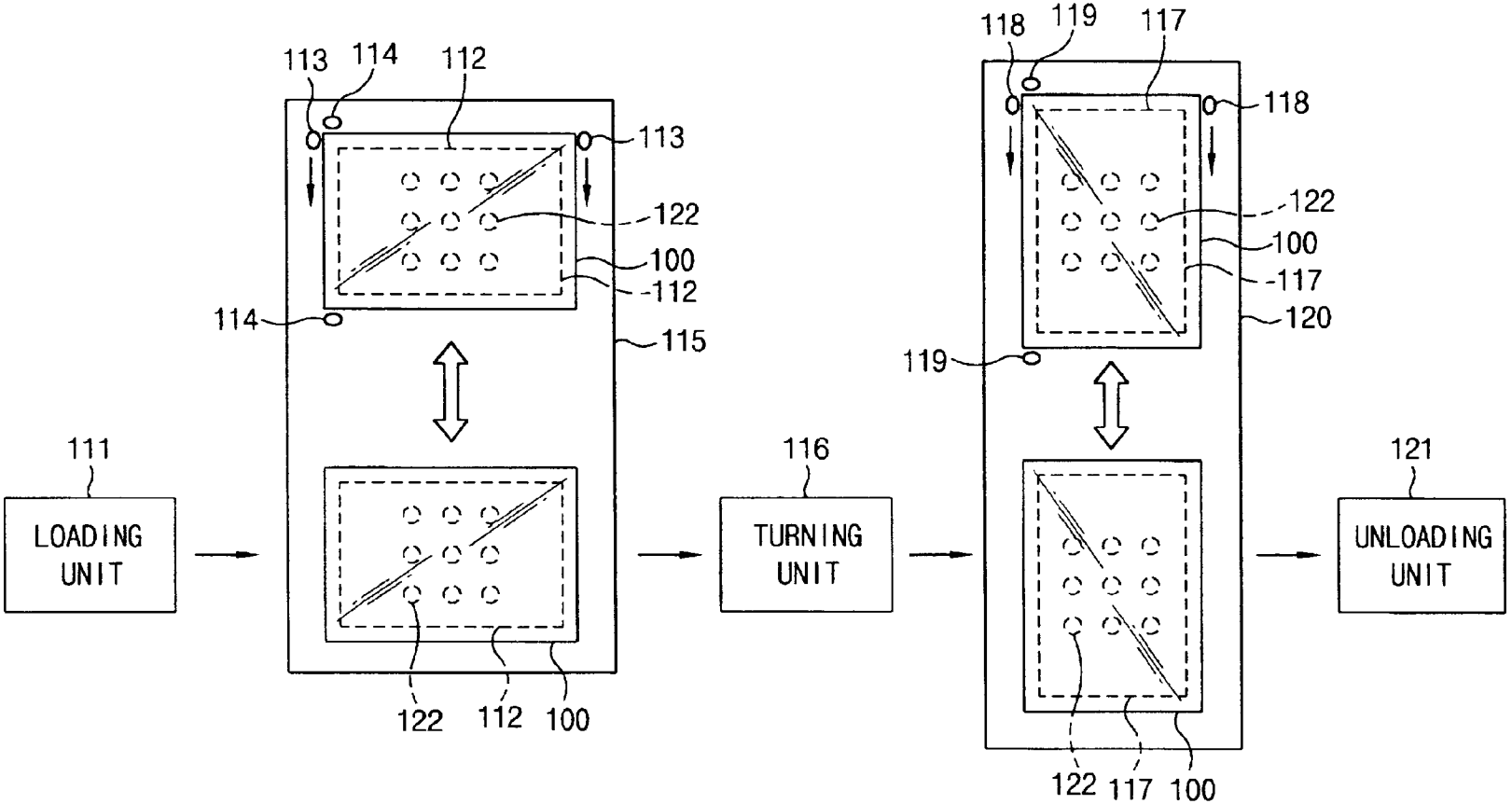
FIG. 5 illustrates a block diagram of a device for grinding a liquid crystal display panel in FIG. 4 for explaining operation of the device in a normal mode.

FIG. 5 illustrates a block diagram of a device for grinding a liquid crystal display panel in FIG. 4 for explaining operation of the device in a normal mode. Operation of the device of the present embodiment to grind the liquid crystal display panel in a normal mode is the same as operation of the device according to the related art.

Namely, the first grinding unit 115, as shown in FIG. 5, receives the unit liquid crystal display panel 100 loaded on the loading unit 111 to align on the first grinding unit 115, and then grinds the edges of the short or long sides of the unit liquid crystal display panel 100. In the embodiment of the present invention, the edges of the short sides of the unit liquid crystal display panel 100 are ground.

The turning unit 116 turns the unit liquid crystal display panel 100 by 90° after the short sides have been ground by the first grinding unit 115.

Subsequently, the second grinding unit 120 receives the unit liquid crystal display panel 100 turned by the turning unit 116 to align on the second grinding table 117 and then grinds the edges of the long or short sides of the unit liquid crystal display panel 100 that were not ground by the first grinding unit 115 through the third grinding wheel 118. In this embodiment of the present invention, the edges of the long sides of the unit liquid crystal display panel 100 are ground.

In another embodiment, the long sides may be ground first by the first grinding unit and then the short sides may be ground by the second grinding unit.

Thereafter, the unloading unit 121 unloads the unit liquid crystal display panel 100.

Yet, if the first or second grinding unit 115 or 120 is broken or malfunctions, the device for grinding the unit liquid crystal display panel according to the embodiment of the present invention is driven in the emergency mode.

Figure 6:
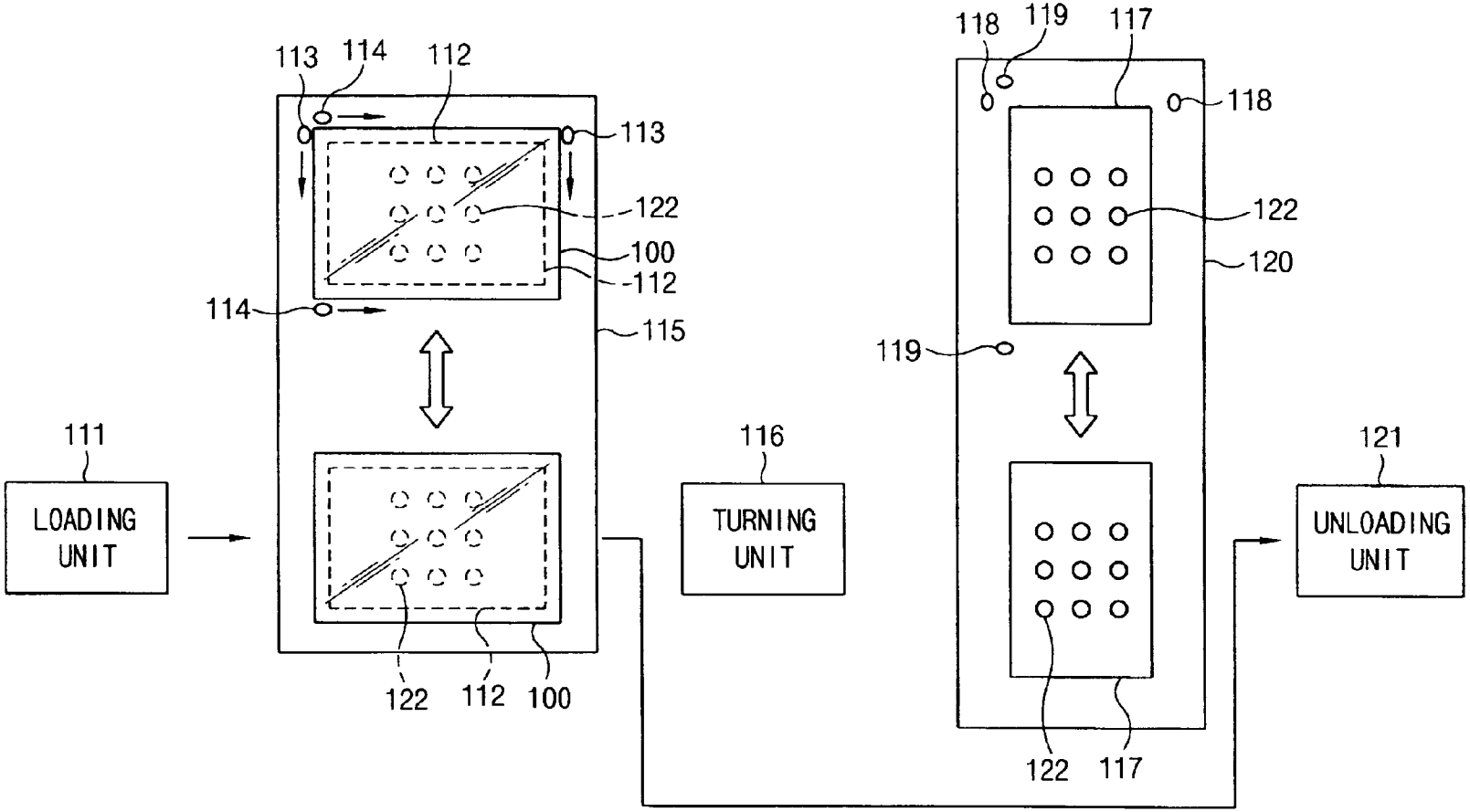
FIG. 6 illustrates a block diagram of a device for grinding a liquid crystal display panel in FIG. 4 for explaining operation of the device in an emergency mode when a second grinding unit is broken or malfunctions.

FIG. 6 illustrates a block diagram of a device for grinding a liquid crystal display panel in FIG. 4 for explaining that the device operates in an emergency mode when a second grinding unit is broken or malfunctions.

Referring to FIG. 6, the first grinding unit 115 receives the unit liquid crystal display panel 100 loaded on the loading unit 111 to align the liquid crystal display panel 100 on the first grinding table 112, and then grinds the edges of the short and long sides of the unit liquid crystal display panel 100 through the first and second grinding wheels 113 and 114.

Thereafter, the unloading unit 121 receives to unload the unit liquid crystal display panel 100 after the edges of the short and long sides have been ground by the first grinding unit 115.

Figure 7:
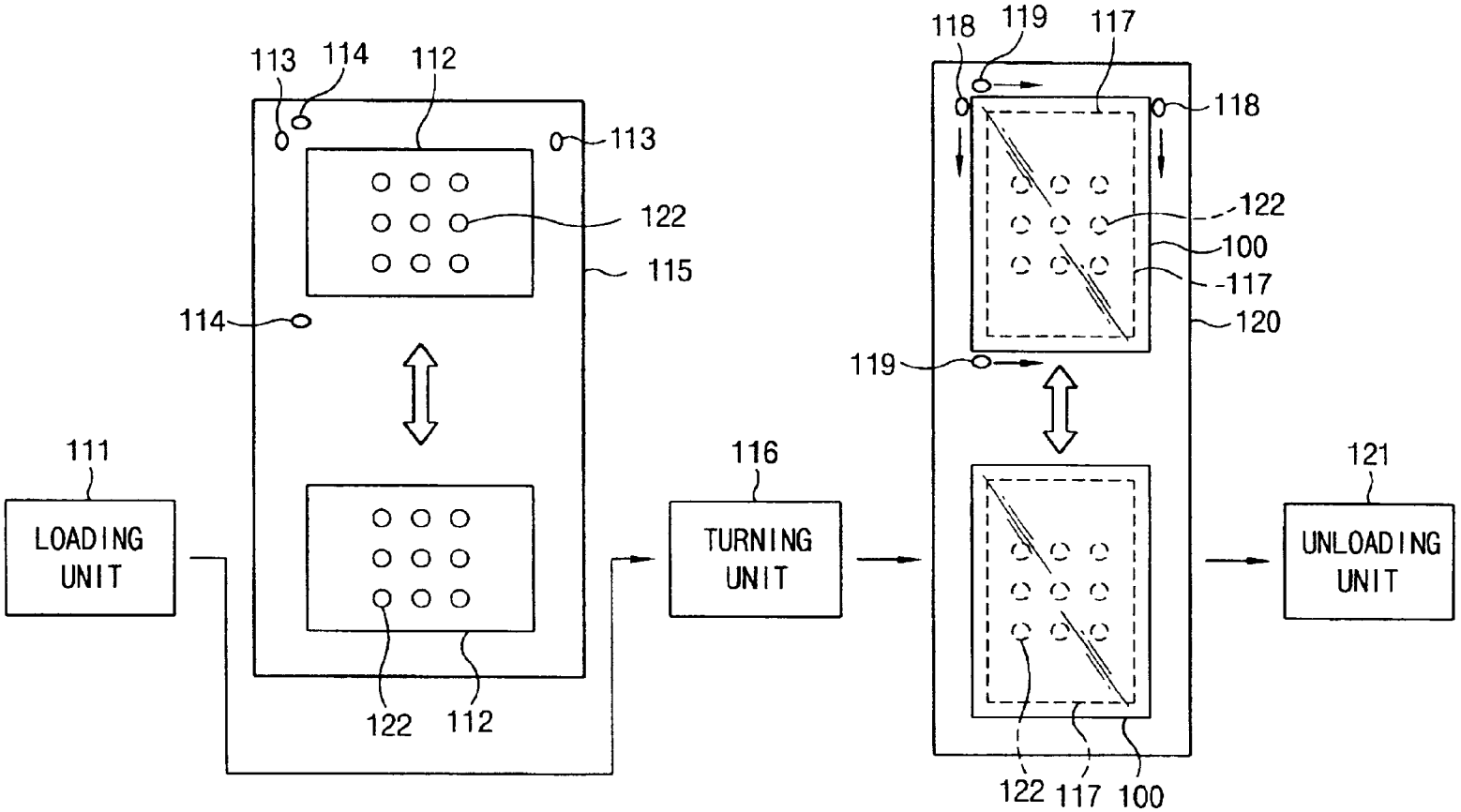
FIG. 7 illustrates a block diagram of a device for grinding a liquid crystal display panel in FIG. 4 for explaining operation of the device in an emergency mode when a first grinding unit is broken or malfunctions.

FIG. 7 illustrates a block diagram of a device for grinding a liquid crystal display panel in FIG. 4 for explaining that the device operates in an emergency mode when a first grinding unit is broken or malfunctions.

Referring to FIG. 7, the second grinding unit 116 receives the unit liquid crystal display panel 100 loaded on the loading unit 111 through the turning unit 116 to align unit liquid crystal display panel 100 on the second grinding table 117, and then grinds the edges of the long and short sides of the unit liquid crystal display panel 100 through the third and fourth grinding wheels 118 and 119.

Thereafter, the unloading unit 121 unloads the unit liquid crystal display panel 100 after the edges of the short and long sides have been ground by the second grinding unit 120.

Accordingly, when the device for grinding the unit liquid crystal display panel according to the present invention is operated in the normal mode, the first grinding unit grinds the edges of the long sides of the unit liquid crystal display panel and the second grinding unit grinds the edges of the short or long sides of the unit liquid crystal display panel that were not ground by the first grinding unit. Therefore, the present invention maximizes productivity.

Moreover, when the device for grinding the unit liquid crystal display panel according to the present invention is driven in the emergency mode if the first or second grinding unit is broken or malfunctions, the first or second grinding unit is able to grind the edges of the long and short sides of the unit liquid crystal display panel. Thus, the present invention can perform the grinding process through the normally operating second or first grinding unit even if the first or second grinding unit cannot be operated. Therefore, the present invention maximizes the use of the equipment, thereby improving productivity.

The forgoing embodiments are merely exemplary and are not to be construed as limiting the present invention. The present teachings can be readily applied to other types of devices. The description of the present invention is intended to be illustrative, and not to limit the scope of the claims. Many alternatives, modifications, and variations will be apparent to those skilled in the art.

What is claimed is:

1. A device for grinding a liquid crystal display panel, comprising:

a first grinding unit including grinding wheels of the first grinding unit for grinding edges of one of short and long sides of the unit liquid crystal display panel in a first mode; and a second grinding unit, the second grinding unit including first grinding wheels of the second grinding unit for grinding the edges of the other of the short and long sides of the unit liquid crystal display panel in the first mode and including second grinding wheels of the second grinding unit being capable of grinding the edges of the one of the long and short sides of the unit liquid crystal display panel in a second mode;

wherein in the first mode, the first grinding unit and the second grinding unit are functional and, in the second mode, only the second grinding unit is functional.

2. The device of claim 1, further comprising a loading unit for transferring the unit liquid crystal display panel to the first grinding unit in the first mode, the loading unit for transferring the unit liquid crystal display panel to one of the first and second grinding unit in the second mode.

3. The device of claim 1, further comprising a turning unit for turning the unit liquid crystal display panel by about 90° wherein the edges of the long or short sides are ground by the first grinding unit in the first mode.

4. The device of claim 1, further comprising an unloading unit for unloading the unit liquid crystal display panel from the second grinding unit in the first mode and from one of the first and second grinding unit in the second mode.

5. A device for grinding edges of a liquid crystal display panel, comprising:

a first grinding unit having a first grinding wheel capable of grinding one of long and short sides of a unit liquid crystal display panel and a second grinding wheel capable of grinding the other of long and short sides of the unit liquid crystal display panel.

6. The device of claim 5, wherein the first grinding unit further includes a first grinding table.

7. The device of claim 6, wherein the first grinding table includes a plurality of suction holes.

8. The device of claim 5, further comprising a second grinding unit having a third grinding wheel capable of grinding one of long and short sides of the unit liquid crystal display panel and a fourth grinding wheel capable of grinding the other of the long and short sides of the unit liquid crystal display panel.

9. The device of claim 8, wherein the second grinding unit further includes a second grinding table.

10. The device of claim 9, wherein the second grinding table includes a plurality of suction holes.

11. A device for grinding a liquid crystal display panel, comprising:

a first grinding unit having a first pair of grinding wheels capable of grinding one of short and long sides of the unit liquid crystal display panel and a second pair of grinding wheels capable of grinding the other of the short and long sides of the unit liquid crystal display panel; and a second grinding unit having at least a third pair of grinding wheels for grinding one of the short and long sides of the unit liquid crystal display panel.

12. The device for grinding a liquid crystal display panel of claim 11, wherein the second grinding unit includes a fourth pair of grinding wheels for grinding the other of the short and long sides of the unit liquid crystal display panel.

13. The device of claim 11, further comprising a loading unit for transferring the unit liquid crystal display panel to one of the first grinding unit and the second grinding unit.

14. The device of claim 11, further comprising a turning unit between the first grinding unit and the second grinding unit for turning the unit liquid crystal display panel by about 90°.

15. The device of claim 11, further comprising an unloading unit for unloading the unit liquid crystal display panel from one of the first grinding unit and the second grinding unit.

16. A method for grinding edges of a liquid crystal display panel, comprising:

grinding first opposing edges of the liquid crystal display panel in a first grinding unit;

grinding second opposing edges of the liquid crystal display panel in a second grinding unit; and grinding first and second edges of the liquid crystal display panel in the first grinding unit if the second grinding unit is not functional.

17. A method for grinding edges of a liquid crystal display panel, comprising:

grinding one of long and short edges of the liquid crystal display panel in a first grinding unit; and grinding the other of long and short edges of the liquid crystal display panel in the first grinding unit.

* * * * *